United States Patent [19]

Peterpaul

[11] 4,368,762

[45] Jan. 18, 1983

[54] TIE SENSING APPARATUS IN A BUNDLING TIE APPLYING TOOL

[75] Inventor: Joseph Peterpaul, West Orange, N.J.

[73] Assignee: Thomas & Betts Corporation, Raritan, N.J.

[21] Appl. No.: 203,691

[22] Filed: Nov. 3, 1980

[51] Int. Cl.[3] ..... B21F 9/02

[52] U.S. Cl. ..... 140/93 A; 140/93.2; 140/123.6

[58] Field of Search ..... 140/38, 49, 52, 53, 140/54, 56, 57, 93 A, 93 R, 93.6, 123.6; 100/4, 6, 26, 33 PB

[56] References Cited

U.S. PATENT DOCUMENTS

| | | | |
|---|---|---|---|
| 3,515,178 | 6/1970 | Hidassy | 140/123.6 |
| 3,946,769 | 3/1976 | Caveney et al. | 140/93.2 |
| 3,976,108 | 8/1976 | Caveney et al. | 140/93 A |
| 4,062,278 | 12/1977 | Cheung | 100/33 PB |

*Primary Examiner*—Lowell A. Larson

*Attorney, Agent, or Firm*—Robert M. Rodrick; Salvatore J. Abbruzzese; Jesse Woldman

[57] ABSTRACT

Tie sensing apparatus is provided in a bundling tie applying tool for sensing presence and absence of a bundling tie on a support within the tool. The support is adjacent a tie loading apparatus in the tool whereby ties transferred from the loading apparatus are positioned thereon. The sensing apparatus, upon sensing absence of a tie on the support operates a switch that provides an indication that the tool requires replenishment of ties. The switch is operable to effectively interrupt operation of the tool until presence of ties is sensed and for actuating a light for visual indication that tie replenishment is required.

20 Claims, 5 Drawing Figures

TIE SENSING APPARATUS IN A BUNDLING TIE APPLYING TOOL

FIELD OF THE INVENTION

This invention relates to a bundling tie applying tool and, more specifically to a tie sensing apparatus in such a tool for actuating a sensing device therein. The present invention is particularly, but not exclusively, useful in the type of tool disclosed in copending patent application, Ser. No. 203,687, filed concurrently herewith, entitled "Bundling Tie Applying Tool," and assigned to the same assignee as is the present invention.

BACKGROUND OF THE INVENTION

Tools for applying bundling ties about wires in harnesses or about other articles are generally known and may be manual, semi-automatic or automatic. Because of high production demands, the automatic tool has become popular. The automatic tool typically includes means for positioning a bundling tie about the wires, tensioning the ties and then severing the tip upon being suitably tensioned. Ties are commonly fed into the tool from a disposable cartridge that may be attached directly to the tool or on a remote dispenser which feeds the ties to the tool under fluid pressure. In another tool arrangement, ties are contained within a chamber in the tool and are fed therefrom to the positioning path.

One problem for the operator in using such tools arises when the supply of ties is depleted. Visual observation of the cartridge and the tie supply therein is commonly the manner in which tie depletion is detected. More often, however, because the operator's attention is usually directed to the application end of the tool, the operator becomes aware of the depleted tie supply when the tool is actuated and no tie is applied. In one known arrangement addressing this problem, a tie probe is provided in a tie dispenser interconnected to the tool at a remote location. When the probe fails to contact a tie in the dispenser chamber, it actuates an audio signal to alert the operator that a new cartridge need be inserted. The operator may ignor the signal and the tool will operate until no tie is available to effect the necessary release of a primary latch from a detent for operation.

SUMMARY OF THE INVENTION

It is an object of the present invention to provide a tie sensing device in a bundling tie applying tool.

It is another object of the present invention to provide a tie sensing apparatus for actuating a sensing device within a bundling tie applying tool.

In accordance with the invention, a tie sensing apparatus is provided in a tool for applying an elongate bundling tie to a plurality of articles to be bundled. The tool is of the type having a housing and supporting means within the housing for supporting a bundling tie thereon. The tie sensing apparatus comprises sensor means for sensing presence and absence of a tie on the supporting means and for providing first and second outputs in response thereto. Included in the tie sensing apparatus is means responsive to one of the first and second outputs for actuating a sensing device.

In a preferred form, the tie sensing apparatus includes switch means that are coupled to circuit means in the tool. The sensor means is adapted to sense absence of the tie and, in response thereto, to operate the switch means. The switch means upon operation, interrupts the operation of the tool. In another arrangement, tie sensing means is provided within the tie loading apparatus of the tool, the loading apparatus including means on the tool housing adjacent the tie supporting means for positioning a bundling tie thereon. Means for sensing presence and absence of a tie on the supporting means is included on the positioning means. In the particular preferred form, the sensing means includes pivotal tie guide means that is pivotal to a first position for sensing tie presence and to a second position for sensing tie absence. Included is means responsive to the pivotal means at the first and second positions, respectively, for actuating and deactuating a sensing device.

DESCRIPTION OF THE PREFERRED EMBODIMENTS

Figure 1:
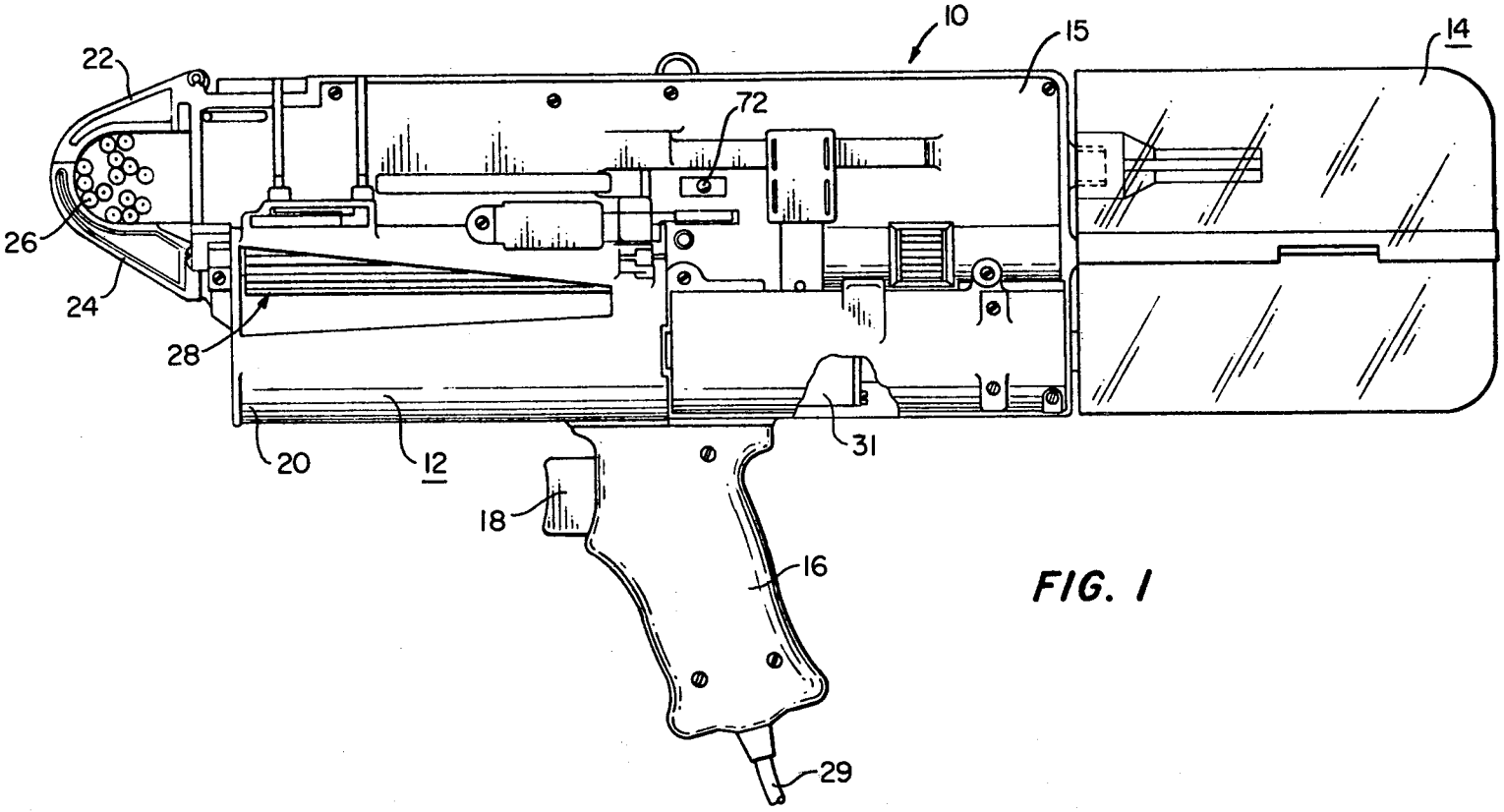
FIG. 1 is a side elevational view of a power-operated, automatic bundling tie applying tool embodying the present invention.

Referring to the drawing, there is shown in FIG. 1 an automatic bundling tie applying tool, generally indicated as numeral 10, incorporating features of the present invention. The tool 10 is preferably of the type as shown and described in copending patent application, U.S. Ser. No. 203,687, entitled "Bundling Tie Applying Tool," filed on even date herewith, and assigned to the same assignee as is the present invention. In brief, the tool 10 is an electrically powered tool capable of installing a bundling tie of the type having an apertured head portion and an elongate, flexible strap portion extending therefrom. The tool 10 has means for receiving ties individually from a series of such bundling ties interconnected between adjacent head portions by a web. Means are included in the tool 10 for advancing the ties to a separating station whereat the web between each head portion is cut thereby providing separated, individual ties. The separated ties are further advanced to a feeding station whereat a reciprocating member feeds and positions an individual bundling tie in a closed loop about the articles to be bundled. Included are means for tensioning the tie about the articles and means for severing the tensioned tie, preferably at a predetermined tension.

Generally, the tool 10 comprises a housing 12, a scrap container assembly 14 suitably attached to the rearward housing end 15 and a handle 16 with a trigger 18 mounted therein. At the forward end 20 of the housing 12 where the ties are applied to a bundle of articles, there are a pair of hook members 22 and 24. The lower hook member 24 is stationary while the upper hook member 22 is movable with respect thereto. The movable upper hook 22 is movable to a position for receipt of a plurality of wires 26 to be bundled. Once the wires 26 have been received within the confines of the hooks 22 and 24, the upper hook is closed to facilitate looping of a cable bundling tie about the wires 26. The tool 10 includes a tie carrying mechanism 28 for supporting a plurality of ties thereon and subsequently advancing the ties to a position in preparation for looping about the wires 26.

Figure 5:
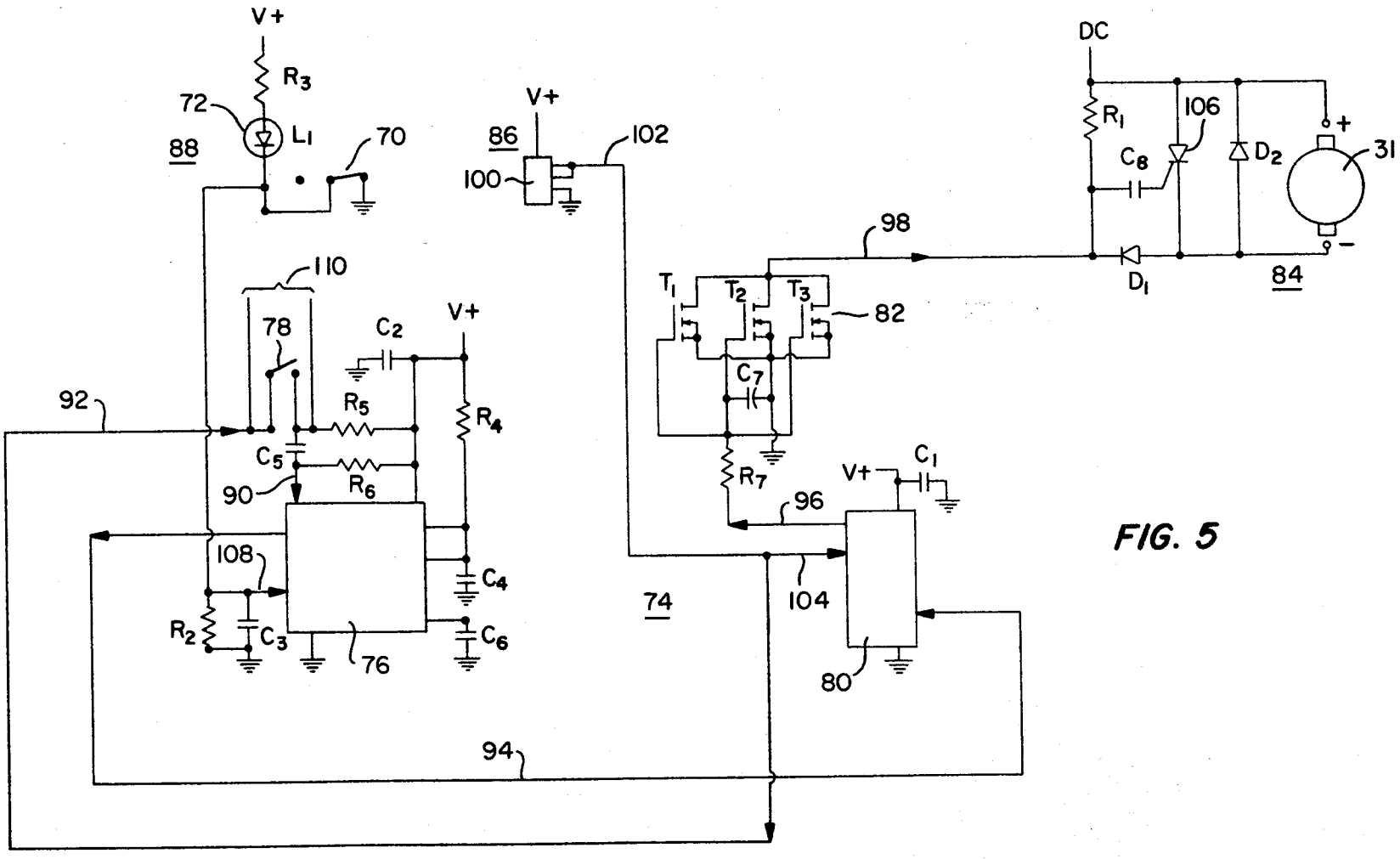
FIG. 5 is a schematic diagram of an electrical control system for the tool embodying the invention.

As further shown in FIG. 1, extending from the bottom portion of the handle 16 is a suitable electric cord 29 for providing electric power to the tool 10. The cord 29 is connected to a suitable source (not shown) of electrical power. The source may be a power supply capable of converting conventional line 110 volt or 220 volt alternating current to direct current for operating an electric motor 31 housed within the tool 10. Alternatively, the source may be a battery supply capable of providing requisite direct current to the tool 10. A suitable electric circuit 74, as shown schematically in FIG. 5, is provided for controlling the operation of the tool 10, the circuit 74 being suitably connected to the cord 29 and thereby the power source.

Figure 2:
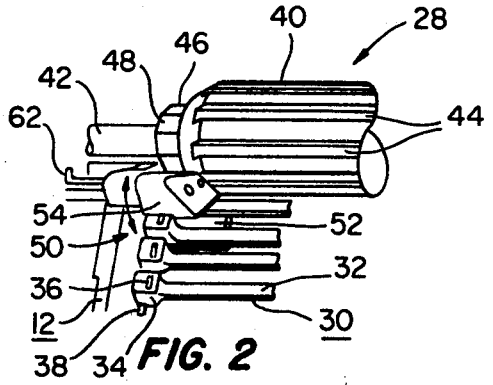
FIG. 2 is a fragmentary perspective view showing tie loading features of the present invention.

Referring now to FIG. 2, the details of the tie carrying mechanism 28 and the tie loading features for facilitating transfer of ties thereto may be appreciated. The bundling ties 30 used in the tool 10 are of the self-locking type comprising an elongate, flexible strap portion 32 and a head portion 34 having a strap-receiving aperture 36 therethrough and may be of the type as shown and described by Noorily in U.S. Pat. No. 3,973,293, assigned to the same assignee as is the present invention. The tool 10 is adapted to receive individually a succession of ties 30 from a suitable supply of ties that are interconnected between adjacent heads 34 by a thin, flexible web 38. The tie carrying mechanism 28 comprises a rotatable drum 40 mounted for rotation in the housing 12. The drum 40 is rigidly secured to a drum shaft 42 that is in turn suitably coupled to an indexing mechanism (not shown) for automatically, rotatably indexing the drum 40 in predetermined arcs of revolution.

Referring still to FIG. 2, the drum 40 is an elongate, generally cylindrical member having a plurality of longitudinally extending grooves 44 spaced about the periphery of the drum 40. In the preferred form, there are ten grooves 44 equally spaced about the drum 40, although any suitable number of grooves may be provided. The grooves 44 are formed to have a depth greater than the thickness of the strap portion 32 and a width slightly greater than the width of the strap portion 32 for accommodating and supporting the ties 30 therein, one tie 30 to a groove 44. At the end of the drum 40, adjacent the shaft 42, the drum 40 has a shoulder 46 having a diameter less than the outer periphery of the drum 40. The shoulder 46 is preferably formed as a decahedron having ten substantially flat faces 48 therearound, each face 48 being aligned with one of the grooves 44. The drum 40, as described, is capable of supporting a series of interconnected ties 30 thereon wherein the strap portions 32 of the ties 30 are accommodated within the grooves 44 with the head portions 34 adjacent the flat faces 48 on the shoulder 46.

Figure 3:
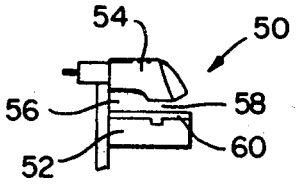
FIG. 3 is a side elevational view of the tie loading mechanism of FIG. 2.

As shown in FIG. 2, a tie loading mechanism 50 is mounted on the housing 12 adjacent the drum shoulder 46. The tie loading mechanism 50 is adapted to individually receive the interconnected ties 30 in succession from the feed of ties 30 suitably supplied to the tool 10 and to position the ties 30 individually in a groove 44. As shown in FIGS. 2 and 3, the loading mechanism 50 comprises a lower support 52 and an upper tie head guide 54 that together define a passageway 56 for entry and passage of a tie head 34 and, in communication with the passageway 56, a gap 58 of lesser dimension for passage of the adjacent strap portion 32 into the loading mechanism 50. The upper head guide 54 may be pivotal with respect to the lower support 52. The exit of the passageway 56 between the lower support 52 and the upper guide 54 is disposed to register with a flat face 48 on the drum shoulder 46 and the gap 58 with a groove 44 at each index position. Thus, as the tie head 34 emerges from the passageway, the strap portion 32 of the tie 30 is positioned in one of the grooves 44. The lower support 52 has an extent 60 that projects laterally beyond the exit and in covering relation to the groove 44 adjacent the shoulder 46 for holding the strap portion 32 in the groove 44. The extent 60 may be flexible for resiliently bearing against the drum 40 to hold the tie 30 in the groove 44 and to thereby provide a means for "snapping" the tie 30 in the loading mechanism 50.

Figure 4:
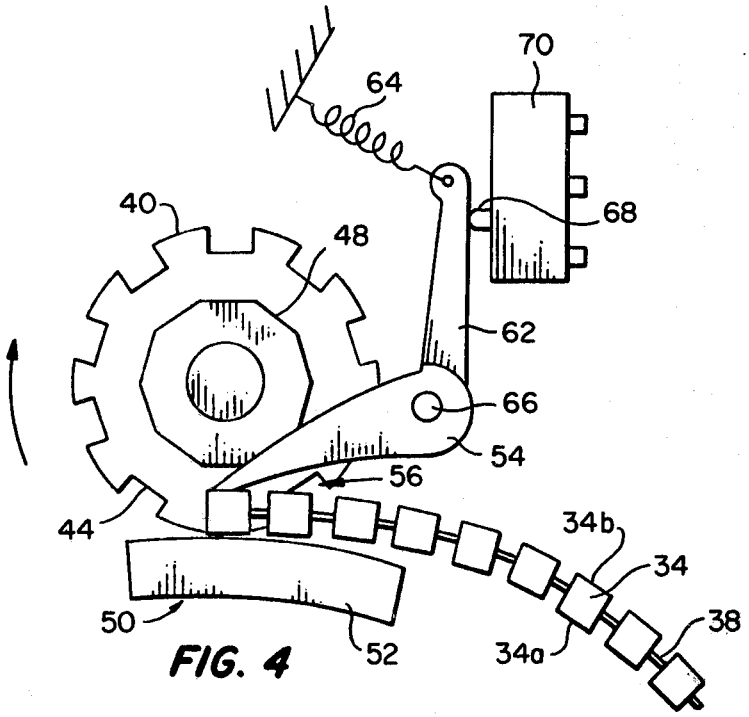
FIG. 4 is a diagrammatic view illustrating the tie loading mechanism with tie sensing features in accordance with the invention.

In accordance with a preferred embodiment of the tie loading mechanism 50, the upper guide 54 is pivotally mounted as indicated in FIG. 2. A lever arm 62 is provided that is pivotable with the pivotal tie guide 54. As shown diagrammatically in FIG. 4, the lever arm 62 and thereby the tie guide 54 are biased as by a spring 64 such that in its normal biased position the guide is pivoted about a pin 66 in a direction toward the lower support 52. Thus, in the normal position the passageway 56 between the lower support 52 and the tie guide 54 is preset to have a dimension less than the thickness of the tie head 34, i.e., the dimension between head surfaces 34*a* and 34*b*. As the tie heads 34 enter the constricted passageway 56 for positioning of the ties 30 in grooves 44, the tie guide 54 is pivotally displaced against the bias of the spring 64 and the lever arm 62 contacts an actuator 68 to actuate a sensing switch 70 suitably mounted on the tool housing 12 and connected to the tool circuit 74. The pivotal upper guide 54 serves as a sensing element for sensing the presence and absence of a tie in the groove 44. The guide 54 is disposed such that sensing occurs in registry with the groove 44 at the "six o'clock" position, i.e., the groove within which ties are positioned by the tie loading mechanism 50. While actuated, the switch 70 provides a signal to the tool circuit 74 to permit operation of the tool. Once the last tie 30 in the series of ties leaves the loading mechanism 50, i.e., when the groove 44 at the "six o'clock" position in FIG. 4 is empty, the spring 64, in the absence of a tie in the groove 44, will pull the lever arm 62 away from the actuator 68, deactuating the switch 70. When the switch 70 is deactuated, a signal is provided in the tool circuit 74 to interrupt and prevent further operation of the tool 10 as will be described with reference to FIG. 5. Also, when the switch 70 is deactuated, a signal may be provided in the tool circuit 74 to actuate a light 72 as shown in FIG. 1, such that the operator would have a visual indication that the tool should be replenished with another supply of ties. An audible indicator may also be provided together with or in place of the visual indicator. With the groove 44 at loading mechanism 50 vacant, the lead tie 30 on another supply of ties may be loaded into the tool. It should be appreciated that, with such a tool interrupting feature, loading delays are avoided. Such an interrupting apparatus is preferably accessible to an operator and may be manually manipulated to override the interlock feature if desired so as to operate an empty tool.

Referring to FIG. 5, electrical circuit 74 for controlling the tool operation is comprised of several functionally distinct sections. A triggering section includes monostable circuit 76, the customary input to which is provided by operation of trigger 18 (FIG. 1) and accompanying closure of trigger switch 78. A drive section is responsive to the triggering section and has driver circuit 80 and power transistor group 82. Mechanical drive is furnished by dynamically braked motor section 84. Limit control unit 86 and tie interlock unit 88 operate respectively in informing the tool control system of cycle progress and of tool tie content.

Considering monostable circuit 76, voltage V+ defines a system HI signal level and electrical ground (zero volts) defines a system LO signal level. Upon momentary closure of switch 78, a negative-going, (HI to LO) trigger signal is applied over line 90 to the SET terminal of the unit 76.

In this connection, line 92 is connected to ground potential through unit 86, such LO signal being applied to the upper plate of capacitor $C_5$ and giving rise to the negative-going triggering signal. Unit 76 is responsive to the triggering signal to provide an output pulse for a period of five hundred miliseconds, thus providing a HI on line 94 during that time period. Driver circuit 80 is activated by the HI condition of line 94 to provide a HI on output line 96. Power transistors $T_1$, $T_2$ and $T_3$ are connected in parallel and are rendered conductive by the HI state of line 96. Line 98 is accordingly rendered LO by conducting to ground through power transistors $T_1$, $T_2$ and $T_3$. On this occurrence, diode $D_1$ of motor section 84 is rendered conductive, motor drive voltage (DC) being a positive voltage selected in accordance with motor 31 characteristics.

In the course of operation of motor 31, a magnectically responsive Hall-effect switch 100 is actuated. At this juncture, line 102 is released from ground potential as is line 104. With line 104 free of ground potential, driver 80 maintains line 96 HI beyond the five hundred milisecond period provided by the HI condition of line 94 due to initial triggering. Motor 31 accordingly continues operation throughout the time period in which the Hall-effect switch 100 is actuated. This cumulative time period of motor operation is approximately one and one half seconds.

At a further point in operation of the tool, switch 100 is deactuated, whereupon line 104 is again returned to ground potential by switch 100 being again conductive to ground. Driver circuit 80 is thus disabled and a single cycle of tool operation is completed. Should trigger switch 78 be retained in closed position, the tool will recycle, since the ground condition of line 102 would then be applied through line 92 to triggering line 90.

By way of a dynamic braking of motor 31 upon completion of a tool cycle, SCR 106 has its control electrode coupled by capacitor $C_8$ and resistor $R_1$ to the terminals of motor 31. As the motor functions as a generator during coastdown, diode $D_1$ is forward biased. SCR 106 is rendered conductive by the generator output voltage and thereupon serves to effectively short the generator output and discontinue rotation of motor 31. Diode $D_2$ is included for protection against inductive kickback during motor operation.

Referring again to the tie interlock unit 88, switch 70 above discussed with reference to FIG. 4 is shown in its condition wherein tie reloading is required. As the switch 70 reaches this condition, i.e., upon the pulling of lever arm 62 away from actuator 68, a ground connection is made directly to light 72 for illumination thereof. Likewise, line 108, which is connected to the reset input of monostable circuit 76, goes from a HI state to a LO state thus providing a resetting trigger to monostable circuit 76. For so long as line 108 remains at ground potential, operation of triggering switch 78 is ineffective to provide an output from circuit 76 to initiate tool cycling. Upon loading ties into the tool, the condition of switch 70 reverts from that indicated in FIG. 5 to its opposite state, releasing the ground on line 108 and permitting tool operation. An external trigger may be applied to lines 110 with equivalent function as the closing of switch 78 where it is desired to operate the system from a remote source.

By way of a specific example of circuitry for use in the FIG. 5 system, the circuit 76 may comprise a 555 Signectics timing chip, driver circuit 80 may comprise an Interdesign MOC1902 8 PIN DIP, transistors $T_1$–$T_3$ may be Siliconix VN 66AF, switch 100 may comprise a Micro Switch Hall Chip 612SS4 4 PIN DIP and switch 70 may comprise a Cherry Switch number E63-00 A miniature snap acting switch. The motor 31 may be a TRW Globe motor, Type EM-15 d.c. gearmotor. Resistance values are: $R_1=10$ Kilohms, $R_2=1$ Megohm, $R_3=1.2$ Kilohms, $R_4=1$ Megohm, $R_5=100$ Kilohms, $R_6=100$ Kilohms, $R_7=15$ Kilohms. Capacitance values are: $C_1=0.01$ microfarads, $C_2=0.01$ microfarads, $C_3=0.47$ microfarads, $C_7=0.47$ microfarads, $C_5=0.47$ microfarads, $C_6=0.01$ microfarads, $C_7=0.47$ microfarads, $C_8=0.01$ microfarads.

Having herein described the preferred embodiment of the present invention, it should be appreciated that various modifications may be made within the contemplated scope of the invention. For example, although the switch 70 is actuated when the actuator 68 is contacted by the lever arm 62, a reverse polarity switch 70 may be used such that upon contact of the actuator 68 by the lever arm 62 the switch is deactuated. Suitable changes could be made in the tool circuit 74 to compensate for the polarity reversal to effect the desired interruption of the tool when the groove 44 at the loading position is vacant. It should also be appreciated that while the tie loading mechanism 50 as described herein preferably embodies the tie sensing features, separate tie sensing apparatus may be utilized.

Although the preferred embodiment of the tie sensing apparatus as described herein is mechanical, other sensing devices producing optical, electrical or magnetic outputs may also be used. Similar to the mechanical output produced by the pivotal guide 54 in sensing the presence and absence of a tie in the groove 44 at the loading position, an optical, electircal or magnetic device may also be positioned to sense the presence or absence of a tie at this groove. The optical, electrical or magnetic output, as the mechanical, may be coupled to a suitable switch for actuation thereof in response to the outputs produced in either the presence or absence sensing modes.

Although the present invention is described herein in the context of an automatic power-operated bundling tie applying tool capable of receiving a series of webbed ties and cutting the webs therein, it should be appreciated that the contemplated scope of the invention is not so limited. For example, the invention may be used in tools for applying bundling ties wherein separate ties are supplied individually to the tool from a cartridge, hose or other loading device. Moreover, the tool may also be semi-automatically operable or manual.

Various other changes to the foregoing, specifically disclosed embodiments and practices will be evident to those skilled in the art. Accordingly, the foregoing preferred embodiments are intended in an illustrative and not in a limiting sense. The true spirit and scope of the invention are set forth in the following claims.

What is claimed is:

1. In a tool for applying an elongate bundling tie to a plurality of articles to be bundled, said tool being of the type having a housing and supporting means within said housing for supporting a bundling tie thereon, a tie sensing apparatus comprising:

a movable member within said housing for movably supporting a bundling tie therein;

sensor means for sensing presence and absence of a tie on said supporting means and for producing first and second outputs, respectively, in response thereto; and means responsive to one of said first and second outputs for preventing movement of said movable member.

2. A tie sensing apparatus according to claim 1 wherein said actuating means is responsive to the other one of said first and second outputs for permitting movement of said movable member.

3. A tie sensing apparatus according to claim 1 wherein said supporting means includes said movable member.

4. A tie sensing apparatus according to claim 3 wherein said supporting means and said movable member are integral.

5. A tie sensing apparatus according to claim 1, wherein said sensor means comprises a movable sensor and wherein said first and second outputs are mechanical movements of said movable sensor.

6. A tie sensing apparatus according to claim 5, wherein said sensing device comprises switch means.

7. In a bundling applying tool for installing an elongate bundling tie to a plurality of articles to be bundled, said tool being of the type having a housing, circuit means for controlling operation of said tool and supporting means within said housing for supporting a bundling tie thereon, a tie sensing apparatus, comprising:

sensor means for sensing absence of a tie on said supporting means and for generating an output in response thereto;

switch means coupled to said circuit means and operable to interrupt the operation of said tool; and means responsive to said output for operating said switch means.

8. A tie sensing apparatus according to claim 7, wherein said switch means comprises contact means and wherein said sensor means comprises a pivotal sensor and wherein mechanical movement of the pivotal sensor in a direction away from said switch contact means defines the output for deactuation of said switch means.

9. A tie sensing apparatus according to claim 7, further including means for indicating absence of said tie, said indicating means being coupled to said switch means and actuatable upon operation of said switch means.

10. A tie sensing apparatus according to claim 9, wherein said indicating means comprises a visual indicator.

11. In a bundling tie applying tool for installing a bundling tie having a head portion and an elongate strap portion extending therefrom to a plurality of articles to be bundled, said tool being of the type having a housing and supporting means within said housing for supporting a bundling tie thereon, a tie loading apparatus, comprising:

means on said housing adjacent said supporting means for positioning a bundling tie thereon, and means on said positioning means for sensing presence and absence of a tie on said supporting means.

12. The loading apparatus according to claim 11, wherein said sensing means is in registry with said tie supporting means.

13. Tie loading apparatus according to claim 11, wherein said sensing means includes pivotal means mounted on said housing for pivotal movement to a first position for sensing presence of said tie and to a second position for sensing absence of a tie.

14. Tie loading apparatus according to claim 13, wherein said pivotal means includes an upper pivotal guide and a lower fixed support defining a passageway for passage of an individual tie head portion.

15. Tie loading apparatus according to claim 14, wherein said upper pivotal guide and said lower fixed support further define in communication with said passageway a gap of lesser dimension than said passageway for passage of an extent of the strap portion adjacent said head.

16. Tie loading apparatus according to claim 14, wherein said upper pivotal guide is biased toward said lower fixed support to thereby present to a tie head positioned thereat an expandably constricted passageway.

17. The loading apparatus according to claim 13, further including means responsive to said pivotal means at said first position for actuating a sensing device.

18. Tie loading apparatus according to claim 13, further including means responsive to said pivotal means at said second position for deactuating a sensing device.

19. Tie loading apparatus according to claim 13, further including means normally biasing said pivotal means toward said second position.

20. In a bundling tie applying tool of the type having a housing and loading means for positioning a tie on supporting means within said housing, a tie sensing apparatus, comprising:

pivotal means mounted on said housing for pivotal movement to a first position for actuating a sensing device and to a second position for deactuating said sensing device, means normally biasing said pivotal means to said second position and tie contact means on said pivotal means responsive to the positioning of said tie on said supporting means for pivoting said pivotal means to said first position.

* * * * *